US008091958B2

(12) United States Patent
Kumazawa

(10) Patent No.: US 8,091,958 B2
(45) Date of Patent: Jan. 10, 2012

(54) CHAIR

(75) Inventor: Taku Kumazawa, Ichinomiya (JP)

(73) Assignee: Aichi Co., Ltd. (JP)

( * ) Notice: Subject to any disclaimer, the term of this patent is extended or adjusted under 35 U.S.C. 154(b) by 209 days.

(21) Appl. No.: 12/492,256

(22) Filed: Jun. 26, 2009

(65) Prior Publication Data

US 2010/0078982 A1 Apr. 1, 2010

(30) Foreign Application Priority Data

Jun. 27, 2008 (JP) ..... 2008-168879

(51) Int. Cl.

| | |
|---|---|
| ***A47B 39/00*** | (2006.01) |
| ***A47B 39/02*** | (2006.01) |
| ***A47B 39/04*** | (2006.01) |
| ***A47B 83/02*** | (2006.01) |

(52) U.S. Cl. ..... 297/141; 297/142; 297/167; 297/174 R

(58) Field of Classification Search ..... 297/141, 297/142, 167, 174 R

See application file for complete search history.

(56) References Cited

U.S. PATENT DOCUMENTS

| | | | | | |
|---|---|---|---|---|---|
| 596,931 | A | * | 1/1898 | Yunck | 297/141 |
| 688,878 | A | * | 12/1901 | Neuendorff | 297/167 |
| 835,976 | A | * | 11/1906 | Newell | 297/174 R |
| 1,026,140 | A | * | 5/1912 | Bauer et al. | 297/141 X |
| 1,513,907 | A | * | 11/1924 | Hugo | 297/174 R |
| 1,652,100 | A | * | 12/1927 | Eastburn | 297/141 |
| 2,098,655 | A | * | 11/1937 | De Lisle | 297/174 R |
| 3,674,228 | A | * | 7/1972 | Horton | 248/642 |

FOREIGN PATENT DOCUMENTS

| | | |
|---|---|---|
| JP | 09108058 | 4/1997 |
| JP | 10075842 | 3/1998 |
| JP | 2002028043 | 1/2002 |
| JP | 2003000380 | 1/2003 |
| JP | 2004230068 | 8/2004 |
| JP | 2009017925 | 1/2009 |
| JP | 2009100817 | 5/2009 |

* cited by examiner

*Primary Examiner* — Rodney B White

(74) *Attorney, Agent, or Firm* — Grossman Tucker Perreault & Pfleger PLLC

(57) ABSTRACT

A chair includes a seat body, a front leg, a rear leg, and a leg receiver. The seat body has a seating face for a person to sit on, and a backrest for a person to lean against. One end of the front leg is attached to an underside region which is underside of the seating face of the seat body, in such a manner that the one end of the front leg is capable of being rotated in relation to the seat body. One end of the rear leg is rotatably attached to the seat body at a position closer to a backrest side than a position at which the one end of the front leg is attached. The leg receiver is arranged on a floor surface. The respective other ends of the front leg and the rear leg are rotatably attached to the leg receiver.

8 Claims, 13 Drawing Sheets

CHAIR

CROSS-REFERENCE TO RELATED APPLICATIONS

This application claims the benefit of Japanese Patent Application No. 2008-168879 filed Jun. 27, 2008 in the Japanese Patent Office, the disclosure of which is incorporated herein by reference.

BACKGROUND

The present invention relates to a chair which can be used in combination with a desk, and a seat body of the chair is configured to be swingable between a front end position and a rear end position. The front end position is a position in which the seat body is swung forward to a predetermined position. The rear end position is a position in which the seat body is swung rearward to a predetermined position.

Conventionally, in a place where desks and chairs are arranged in groups, such as a lecture room in a school, a chair is used which is configured such that, when seated, the chair is moved to the rear end position in which a seat body to be seated is swung rearward, and when not seated, the chair is moved to the front end position in which the seat body is swung forward and stored.

As such a chair, Unexamined Japanese Patent Publication No. 2002-028043 discloses an example of a chair in which a seat part and a base portion are connected by a front side leg portion and a rear side leg portion to form a four-link joint, thereby allowing the seat part to be swung in a front-and-rear direction. The seat part includes a backrest and a seat. The base portion is arranged on a floor surface. In the four-link joint of this chair, it is configured that a distance between a swing axis at an upper end part of the front side leg portion and a swing axis at an upper end part of the rear side leg portion, is longer than a distance between a swing axis at a lower end part of the front side leg portion and a swing axis at a lower end part of the rear side leg portion. When this chair is swung most forward at the front end position, the seat and the backrest are tilted forward.

In the chair constituted as above, the backrest is tilted forward at the front end position. Thus, when a person is passing behind the chair, even if a height of a waist area which is a relatively wider part of the person and a height of the upper end of the backrest of the seat part are approximately the same, the upper end of the backrest is not likely to be brought into contact with the waist area. Obstruction of a person's passage by the backrest could be inhibited.

SUMMARY

In an example described above, since the upper end part of the backrest is tilted forward, the rear end part of the backrest is tilted rearward. Therefore, although a large space can be obtained at a height corresponding to the waist area of the person, a space obtained at a height below the height corresponding to the waist area is narrower. Accordingly, there is a problem in which there is a high possibility that legs of people or a bag carried by a person come into contact with the chair, thereby obstructing a person's passage.

In one aspect of the present invention, it is desired to allow a person to easily pass behind a chair.

A chair according to a first aspect of the present invention has a seat body, a front leg, a rear leg, and a leg receiver.

The seat body includes a seat part and a backrest.

The seat part has a seating face for a person to sit on.

The backrest is intended for a person to lean against.

One end of the front leg is rotatably attached to an underside region of the seat part. The underside region is in the opposite side of the seating face. The one end of the front leg is capable of being rotated in relation to the seat body.

The other end of the front leg is attached to the leg receiver and capable of being rotated in relation to the leg receiver.

At the underside region of the seat part, one end of the rear leg is rotatably attached to a position closer to a backrest than the position at which the one end of the front leg is attached.

The other end of the rear leg is attached to the leg receiver and capable of being rotated in relation to the leg receiver.

The seat body is capable of being swung between a front end position and a rear end position. The front end position is a position in which each of the front leg and the rear leg are swung to a predetermined end position in a forward direction which goes from the rear leg toward the front leg. The rear end position is a position in which each of the front leg and the rear leg are swung to a predetermined end position in a rearward direction which is opposite to the forward direction.

At the front end position, the backrest is configured to be upright in a substantially vertical direction.

In the chair constituted as above, when the seat body is at the front end position, a space is uniformly formed behind the chair so as to allow a person to easily pass behind the chair. When the chair is at the front end position, if an upper end part of the backrest is tilted rearward, a space becomes narrow at a height in a vicinity of a waist area which is a relatively wider part of a person, thereby obstructing the person's passage. When the chair is at the from end position, if the upper end part of the backrest is tilted forward and a lower end part of the backrest is tilted rearward, the backrest can be brought into contact with legs of a person or a bag carried by a person, thereby obstructing the person's passage. However, in a case of the chair constituted as above, the above-mentioned problems are not likely to be caused. Thus, the person can comfortably pass behind the chair.

A chair according to a second aspect of the present invention is characterized in that, at the front end position, the seating face of the seat body is substantially horizontal.

In the chair constituted as above, when the seat body is moved to the front end position, the seating face is not greatly tilted forward or rearward. Therefore, if baggage is placed on the seating face, the baggage will not be slid off from the seating face. Therefore, the baggage can be placed on the seating face. Accordingly, it is not necessary to place the baggage on a top panel of a desk or to push the baggage into a small shelf under the top panel.

A chair according to a third aspect of the present invention is characterized in that, a distance between a rotation axis at the one end of the front leg and a rotation axis at the one end of the rear leg, is longer than a distance between a rotation axis at the other end of the front leg and a rotation axis at the other end of the rear leg.

In the chair constituted as above, when the seat body is swung from the rear end position to the front end position, the seat body is tilted forward, and tilts of the backrest and the seating face are changed. For this reason, it is possible to configure that the backrest is slightly tilted rearward at the rear end position, and the backrest is substantially vertical at the front end position.

A chair according to a fourth aspect of the present invention is characterized in that, a distance between the rotation axis at the one end of the front leg and the rotation axis at the other end of the front leg, is longer than a distance between the rotation axis at the one end of the rear leg and the rotation axis at the other end of the rear leg.

In the chair which has the front leg longer than the rear leg as mentioned above, when the seat body is swung forward, the seat body is tilted rearward. As a result of an action provided by a configuration according to the third aspect of the present invention, when the seat body is swung from the rear end position to the front end position, a tilt of the seat body is changed to a direction in which the seat body is tilted forward. In the chair as constituted according to the fourth aspect of the present invention, however, in a vicinity of the front end position, an action to tilt the seat body rearward is caused. Therefore, the state, in which the seat body is extremely tilted forward at the front end position, can be inhibited. Accordingly, it is possible to adjust the angle of the backrest in an appropriate manner.

A chair according to a fifth aspect of the present invention is characterized in that, the rotation axis at the other end of the front leg is, in comparison with the rotation axis at the other end of the rear leg, arranged at a position closer to the floor surface at the leg receiver.

In the chair constituted as above, in the case where the rear leg is relatively short by applying a configuration of the fourth aspect, a position of the rotation axis at the one end of the rear leg can be located to a higher position. In this way, a difference between the height at the one end of the front leg and the height at the one end of the rear leg can be made small. Thus, it is not necessary to constitute a large member to which the rotation axis is attached at the seat body. As a result, it may be avoided to configure the seat body unnecessarily large.

A chair according to a sixth aspect of the present invention is characterized in that, at the underside region of the seat body, the front leg and the rear leg are attached to a region shifted from a center point of the underside region to a forward direction in a front-and-rear direction.

In the chair constituted as above, positions at the seat body, at which the front leg and the rear leg are attached, are shifted to the forward direction. Therefore, when the seat body is at the front end position, it can be inhibited that the front leg, the rear leg, and the leg receiver are positioned greatly rearward of the seat body. Accordingly, obstruction of a person's passage can be inhibited.

A chair according to a seventh aspect of the present invention includes a stopper that restricts a range within which the front leg and the rear leg are capable of being swung.

A chair according to an eighth aspect of the present invention includes a seat body and a leg.

The seat body includes a seat part having a seating face for a person to sit on.

One end of the leg is connected at a floor surface side and the other end of the leg is connected to the seat body.

The leg is configured to be capable of being swung around a connecting point of the leg with the floor surface side. The leg is configured to be capable of being swung within a pre-determined range in a predetermined direction. The seating face is configured to be maintained substantially parallel in relation to a horizontal plane at a side of at least one of both ends of the range within which the leg is capable of being swung.

In a chair according to the ninth aspect of the present invention, within the swingable range of the leg, the seating face is configured to be maintained substantially parallel in relation to a horizontal plane, regardless of a swinging position of the leg.

In the chair constituted as above, the seating face is neither greatly tilted forward nor rearward. Thus, when baggage is placed on the seating face, the baggage is not likely to be slid off from the seating face. Thus, the baggage can be placed on the seating face.

A chair according to another aspect of the present invention is characterized as following. That is, in a case that a user is seated on the seating face, a boundary position at which the seat body can be swung forward most is defined as a middle position. A rotation angle, through which the rear leg is rotated from the rear end position to the middle position is defined as $\alpha$. The other end serves as a center of the rotation. In this case, an angle $\beta$ between the rear leg at the rear end position and a vertical line may fall within an angle range of $(3/4)\alpha \geqq \beta \geqq (1/4)\alpha$.

In the chair constituted as above, when the seat body is at the rear end position, the front leg and the rear leg are slightly tiled rearward from the vertical line. When the seat body is swung forward while a user is seated, such as, when a person passes behind the chair, it is not necessary to greatly raise the seat body. Thus, the seat body can be easily swung forward. If a user is seated on the seat body when the seat body is at the rear end position, a rearward force is applied thereto by the user's weight. Thus, the seat body can be made stable at the rear end position.

The above described tilt angle of the rear leg is an angle of a line connecting an upper rotation axis and a lower rotation axis of the rear leg, from the vertical line.

BRIEF DESCRIPTION OF THE DRAWINGS

Hereinafter, an embodiment to carry out the present invention will be described in detail with reference to the drawings, in which.

DESCRIPTION OF THE EMBODIMENTS (1) Overall Configuration

Figure 1:
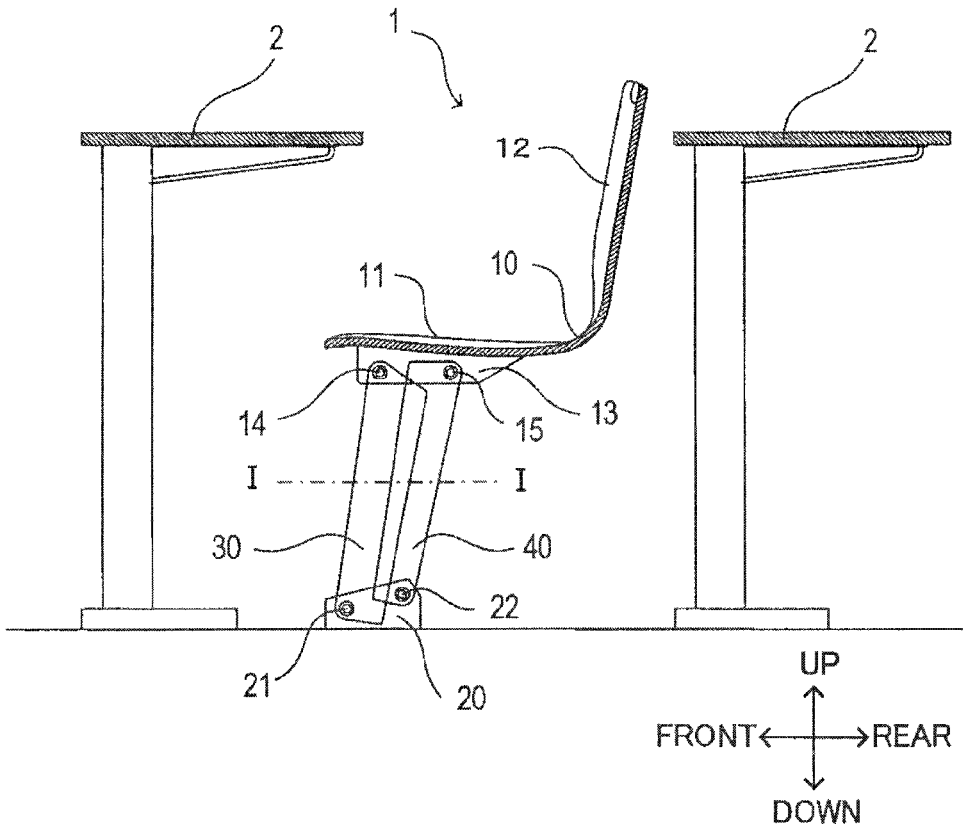
FIG. 1 is a side elevational view showing a chair according to the embodiment.

As shown in FIG. 1, a chair 1 of the present embodiment includes a seat body 10, a leg receiver 20, a front leg 30, and a rear leg 40. One end of each of the front leg 30 and the rear leg 40 is attached to the seat body 10. The other end of each of the front leg 30 and the rear leg 40 is attached to the leg receiver 20. In a place where desks 2 and the chairs 1 are closely arranged, such as a lecture room, a plurality of combinations of the chairs 1 and the desks 2 are arranged in rows and lines.

The seat body 10 has a seating face 11 extending in a front-and-rear direction, and a backrest 12 extending in a direction which intersects with the seating face 11. When the chair 1 is used, a user can lean against the backrest 12 and be seated on the seating face 11.

The seat body 10 has a seat receiver 13 at a region underside of the seating face 11. The seat receiver 13 has a first shaft 14 connected to the one end of the front leg 30, and a second shaft 15 arranged further rearward of the first shaft 14 and connected to the one end of the rear leg 40.

The leg receiver 20 is a member arranged on a floor surface, and has a third shaft 21 and a fourth shaft 22. The third shaft 21 is connected to the other end of the front leg 30. The fourth shaft 22 is arranged further rearward and upward of the third shaft 21 and connected to the other end of the rear leg 40.

The front leg 30 and the rear leg 40 are rotatable in relation to the seat body 10, respectively, around the first shaft 14 and the second shaft 15 each of which serves as a rotation axis. The front leg 30 and the rear leg 40 are rotatable in relation to the leg receiver 20, respectively, around the third shaft 21 and the fourth shaft 22 each of which serves as a rotation axis. As a result, the seat body 10 is capable of being swung in the front-and-rear direction.

Arrangement of each shaft will be explained. It is configured that a distance between the first shaft 14 and the third shaft 21 at the front leg 30 is longer than a distance between the second shaft 15 and the fourth shaft 22 at the rear leg 40. It is configured that a distance between the first shaft 14 and the second shaft 15 at the seat body 10 is longer than a distance between the third shaft 21 and the fourth shaft 22 at the leg receiver 20.

The first shaft 14 and the second shaft 15 are attached to a front region of the seat body 10. The third shaft 21 is located at a position lower than the fourth shaft 22.

Figure 2:
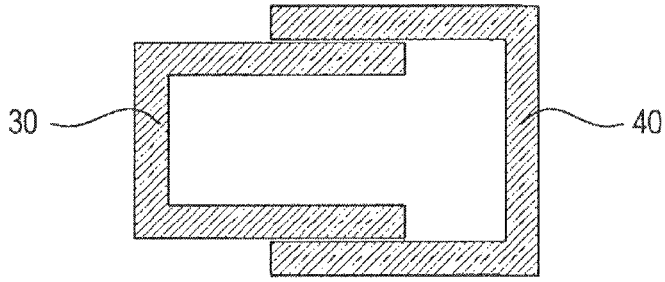
FIG. 2 is a cross sectional view of a front leg 30 and a rear leg 40.

The front leg 30 and the rear leg 40 each has a U-shaped transverse cross section (a cross section along I-I in FIG. 1). Opening portions of the U-shaped legs 30 and 40 face each other and loosely fit into each other (see FIG. 2).

Figure 3A:
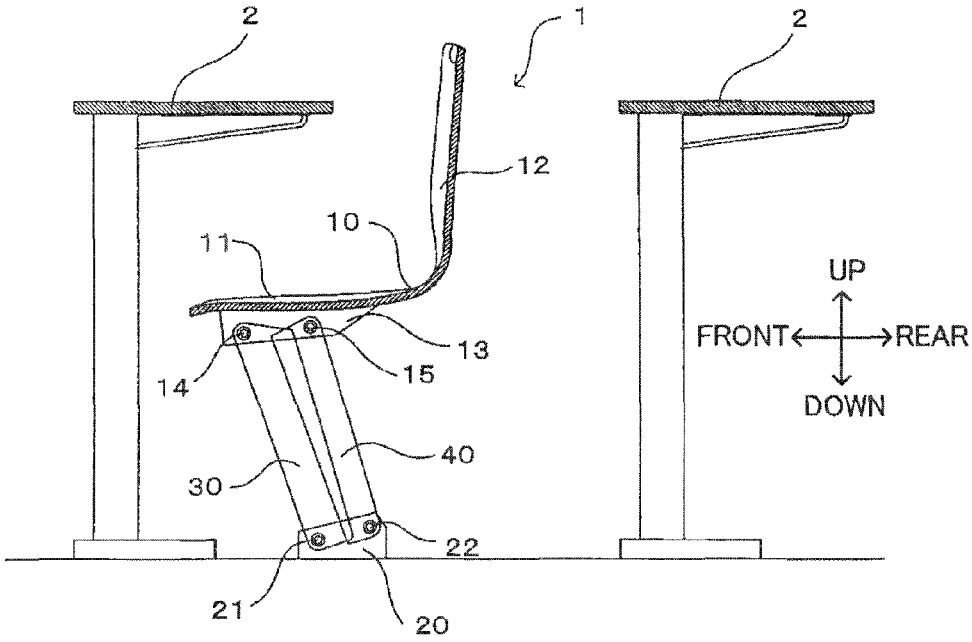
FIG. 3A is a side elevational view showing the chair in a middle position.
Figure 3B:
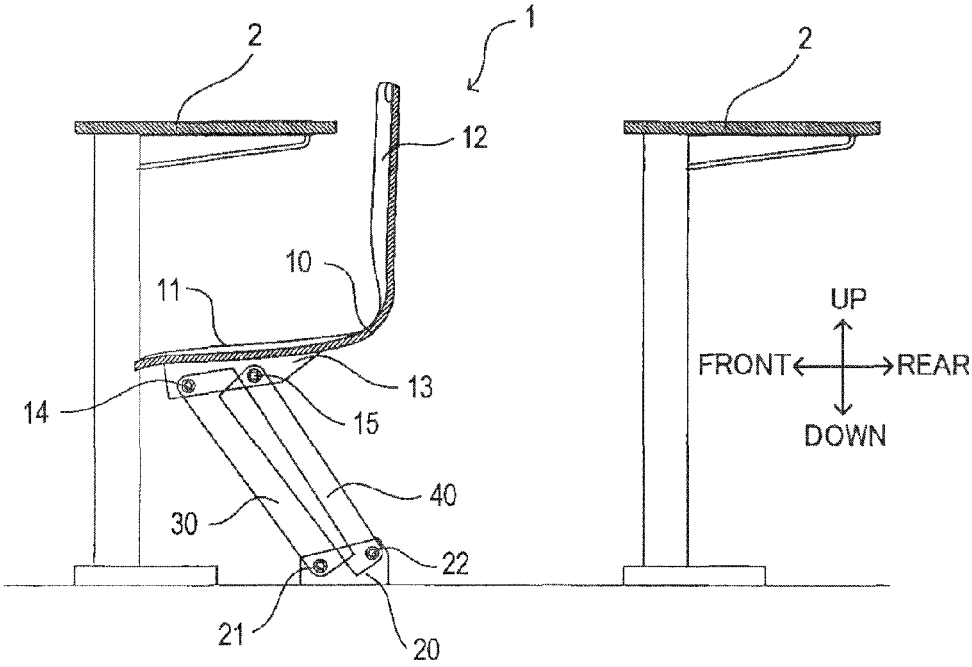
FIG. 3B is a side elevational view showing the chair in a front end position.

The seat body 10 is capable of being swung from a rear end position (see FIG. 1) via a middle swing position (see FIG. 3A) to a front end position (see FIG. 3B). The rear end position is a position in which the seat body 10 is swung rearward. The middle swing position is a position in which the seat body 10 is swung forward and located in around the middle of the swing range. The front end position is a position in which the seat body 10 is further swung forward. The setting of the swing range of the seat body 10 is realized, as shown in FIGS. 9 to 14, by limiting a rotation of the front leg 30 or the rear leg 40 by means of a stopper.

Figure 9:
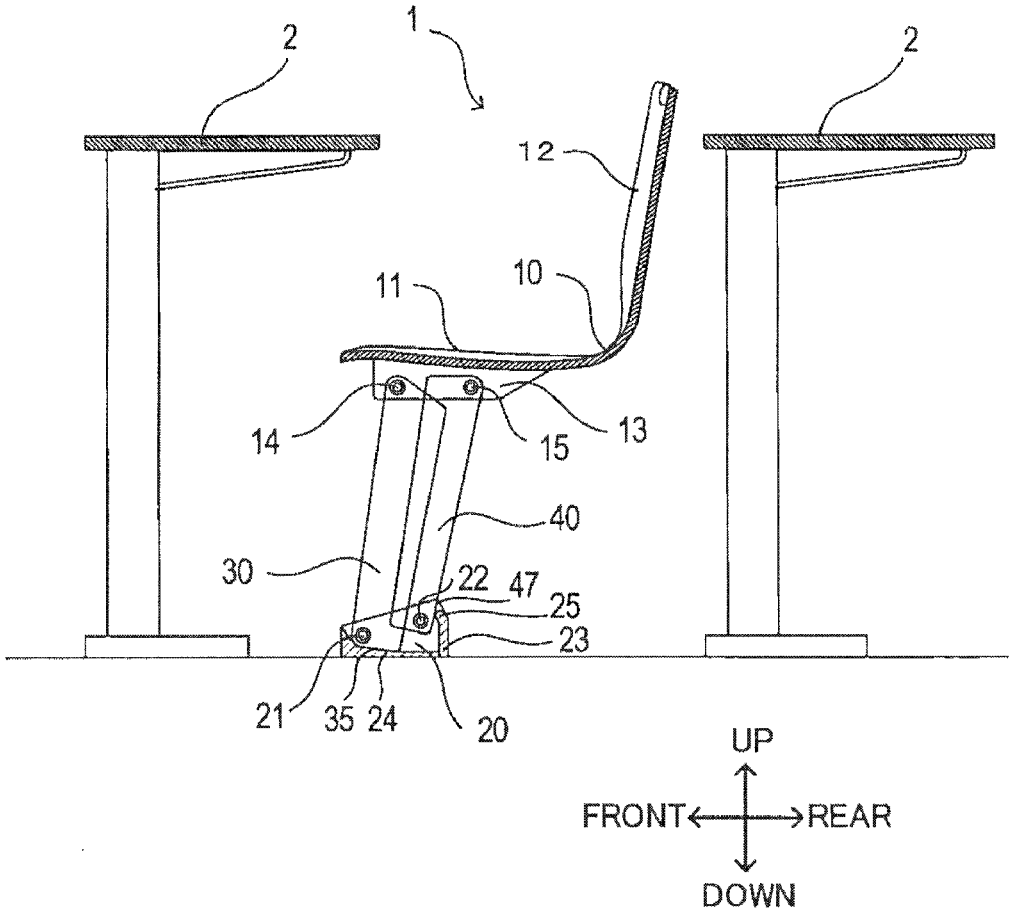
FIG. 9 is a view showing a state in which a rear end position is defined by a stopper configuration according to a first example.
Figure 10:
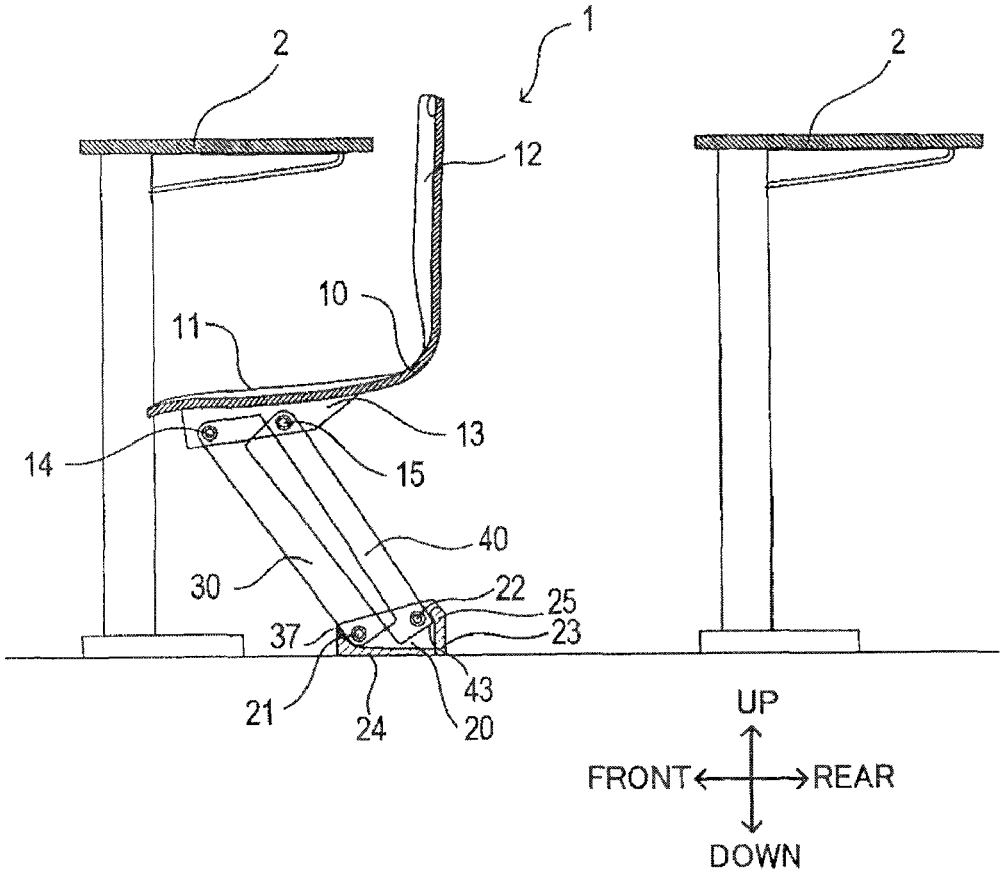
FIG. 10 is a view showing a state in which a front end position is defined by the stopper configuration according to the first example.

In a first example shown in FIGS. 9 and 10, the leg receiver 20 for securing the front leg 30 and the rear leg 40 to the floor surface, also functions as the stopper which defines a swinging range of the front leg 30 and the rear leg 40.

The leg receiver 20 includes an interior space configured to receive the other end (an end at the side of the third shaft 21) of the front leg 30 and the other end (an end at the side of the fourth shaft 22) of the rear leg 40. The interior space is formed by a wall member 23 and a bottom member 24 and the like which are configured to be an outer wall of the leg receiver 20.

FIG. 9 is a view showing a state in which the seat body 10 is swung to the rear end position.

When the seat body 10 is swung rearward (i.e., when the front leg 30 and the rear leg 40 are swung rearward), an end face 35 at the other end (the end at the side of the third shaft 21) of the front leg 30 is eventually brought into contact with an upper surface of the bottom member 24. Thus, the front leg 30 is not allowed to be swung further rearward. That is, the front leg 30 is inhibited from being swung rearward by the bottom member 24. When the front leg 30 is inhibited from being swung, the rear leg 40 cannot be swung as well.

In the present example, as shown in FIG. 9, at the rear end position, an end face 47 at a lower rear side of the rear leg 40 is configured to be brought into contact with an end portion 25 of the wall member 23. That is to say, at the rear end position, the rear leg 40 itself is also inhibited from being swung by the end portion 25 of the wall member 23.

FIG. 10 is a view showing a state in which the seat body 10 is swung to the front end position.

When the seat body 10 is swung forward (i.e., when the front leg 30 and the rear leg 40 are swung forward), a corner part 43 at the lower rear side of the rear leg 40 is eventually brought into contact with the end portion 25 of the wall member 23 in the leg receiver 20. Thus, the rear leg 40 is not allowed to be swung further forward. That is, the rear leg 40 is inhibited from being swung forward by the wall member 23. When the rear leg 40 is inhibited from being swung, the front leg 30 cannot be swung as well.

In the present example, as shown in FIG. 10, at the front end position, an end face 37 at a lower front side of the front leg 30 is configured to be brought into contact with a front side surface of the bottom member 24. That is to say, at the front end position, the front leg 30 itself is also inhibited from being swung by the bottom member 24.

Figure 11:
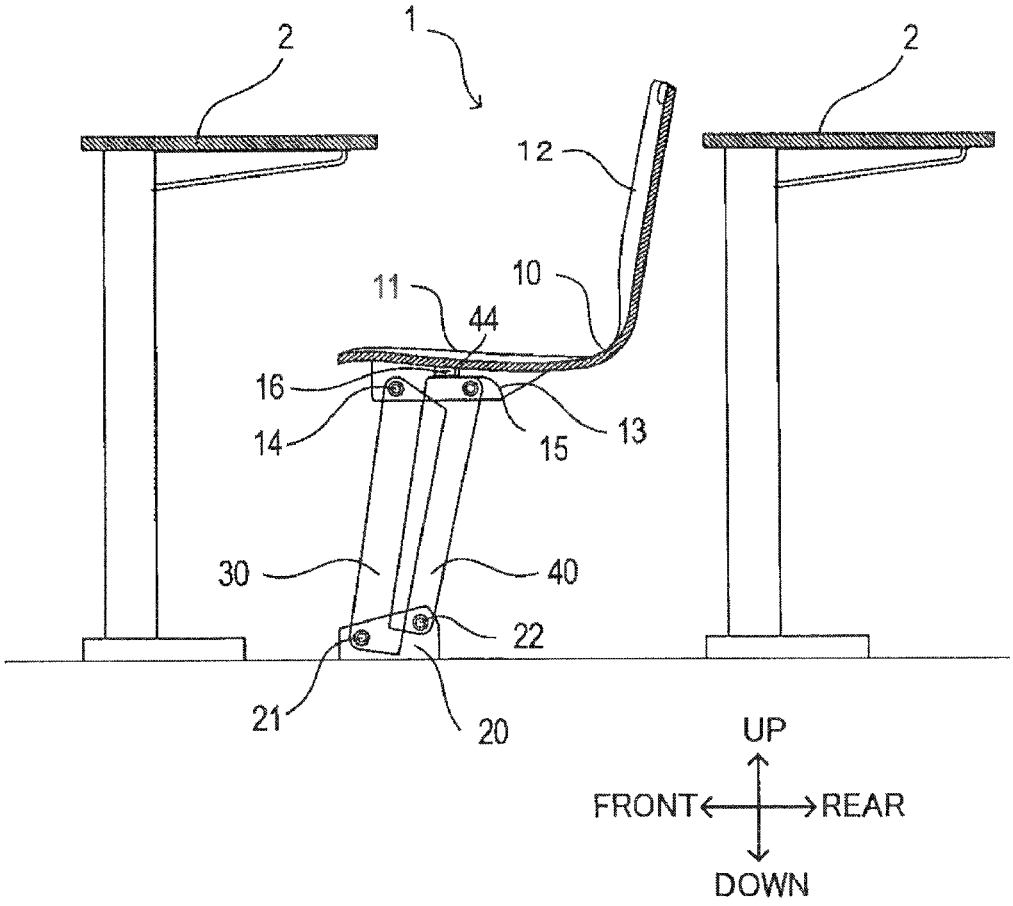
FIG. 11 is a view showing a state in which a rear end position is defined by a stopper configuration according to a second example.
Figure 12:
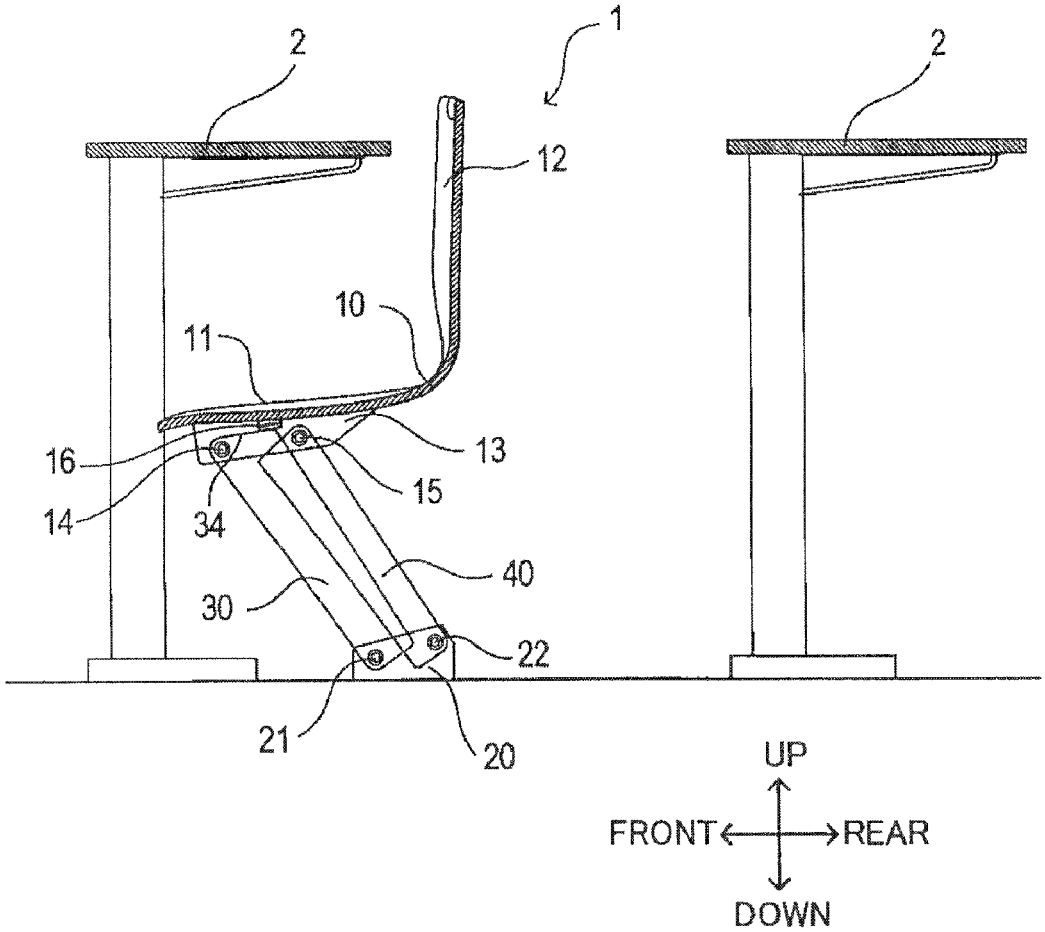
FIG. 12 is a view showing a state in which a front end position is defined by the stopper configuration according to the second example.

In a second example shown in FIGS. 11 and 12, a stopper member 16 is provided at an underside of the seating face 11.

As shown in FIG. 11, at the rear end position, an upper end face 44 of one end (an end at the side of the second shaft 15) of the rear leg 40 is brought into contact with the stopper member 16. More specifically, as the rear leg 40 and the front leg 30 are swung rearward, the end face 44 of the rear leg 40 comes closer to an underside region of the seating face 11, and the end face 44 is eventually brought into contact with the stopper member 16 provided on the underside region of the seating face 11. Thus, the end face 44 of the rear leg 40 cannot come further closer to the underside region of the seating face 11. In other words, the rear leg 40 is not allowed to be swung further rearward. That is, the rear leg 40 is inhibited from further being swung rearward by the stopper member 16. When the rear leg 40 is inhibited from being swung, the front leg 30 cannot be swung as well.

As shown in FIG. 12, at the front end position, an upper end face 34 of one end (an end at the side of the first shaft 14) of the front leg 30 is brought into contact with the stopper member 16. More specifically, as the front leg 30 and the rear leg 40 are swung forward, the end face 34 of the front leg 30 comes closer to the underside region of the seating face 11, and the end face 34 is eventually brought into contact with the stopper member 16 provided on the underside region of the seating face 11. Thus, the end face 34 of the front leg 30 cannot come further closer to the underside region of the seating face 11. In other words, the front leg 30 is not allowed to be swung further forward. That is, the front leg 30 is inhibited from further being swung forward by the stopper member 16. When the front leg 30 is inhibited from being swung, the rear leg 40 cannot be swung as well.

Figure 13:
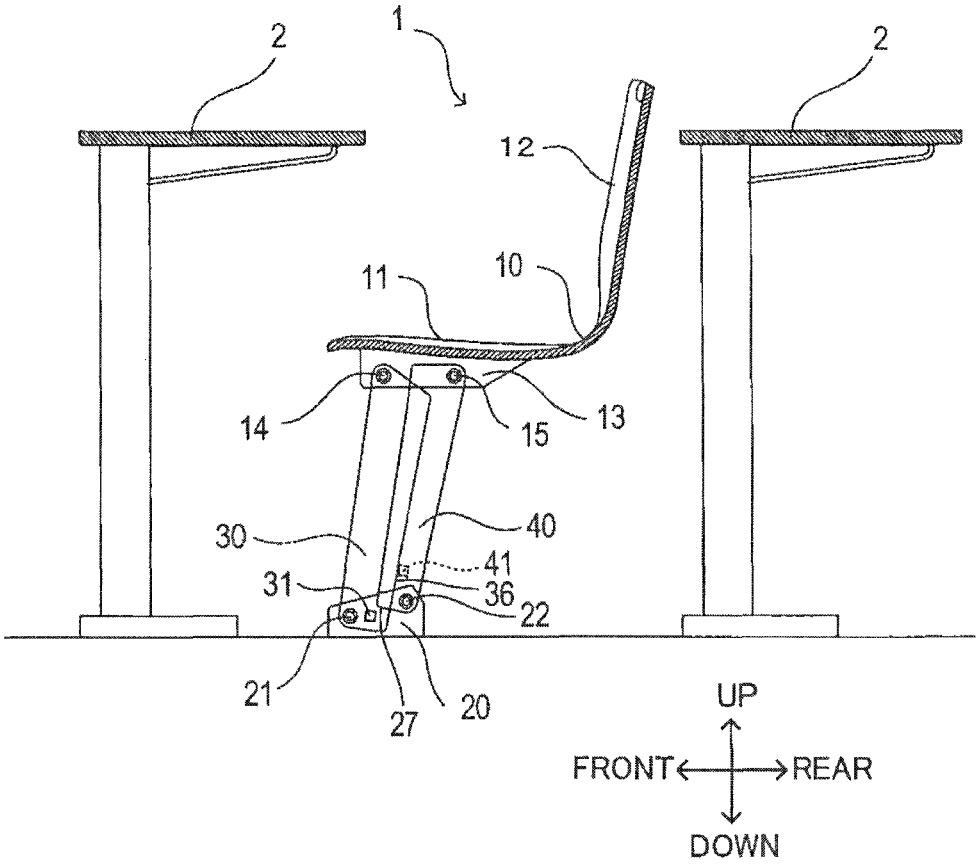
FIG. 13 is a view showing a stopper configuration according to a third example.
Figure 14:
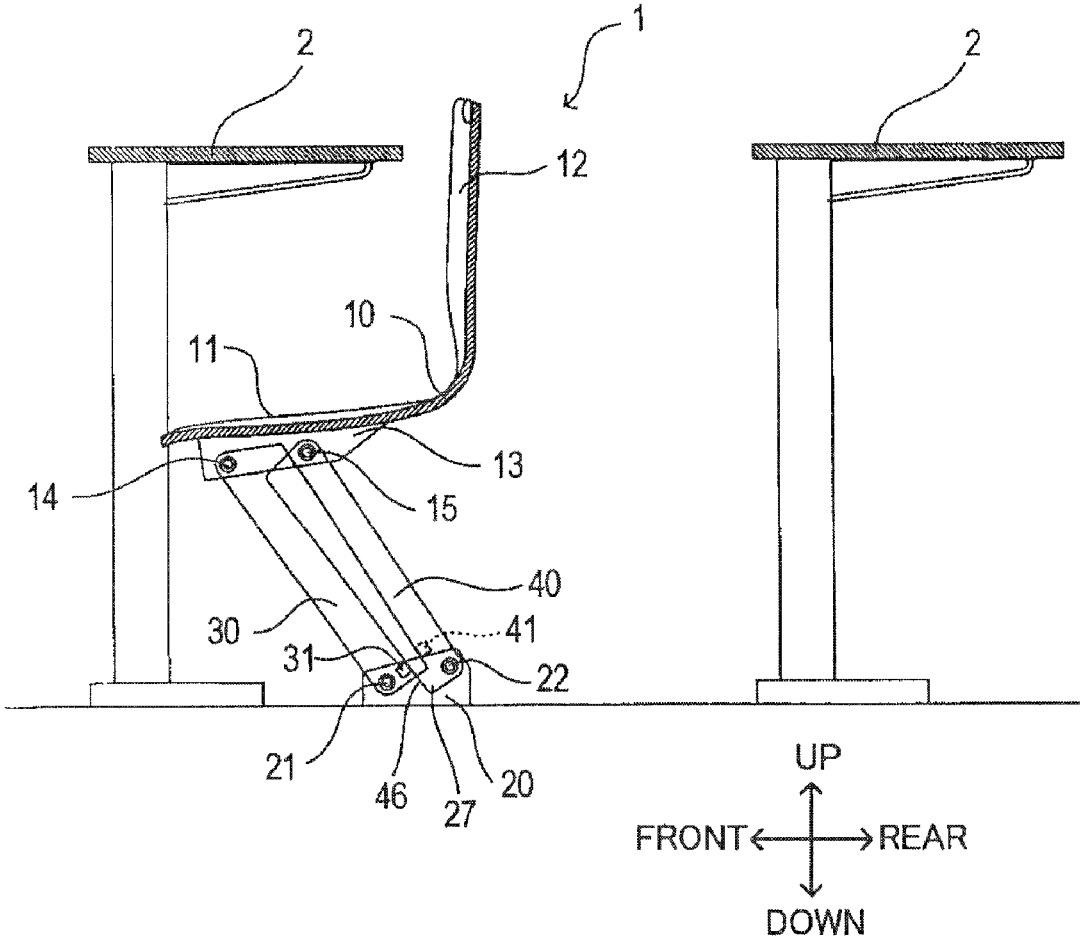
FIG. 14 is a view showing the stopper configuration according to the third example.

A configuration in a third example shown in FIGS. 13 and 14 may be combined with the above described first and second examples. In the third example, a front leg 30 includes a stopper member 31 and a rear leg 40 includes a stopper member 41.

More specifically, the stopper member 31 is provided on an outer wall surface of the other end of the front leg 30 in such a manner that the stopper member 31 is arranged in a vicinity of an axis of the third shaft 21 provided at the side of the other end of the front leg 30. The stopper member 41 is provided in a region of an inner wall surface at the side of the other end of the rear leg 40.

FIG. 13 is a view showing a state in which a seat body 10 is swung to the rear end position.

At the rear end position, an end face 36 rearward of the front leg 30 is brought into contact with the stopper member 41, thereby inhibiting the front leg 30 from further being swung.

If the seat body 10 is swung forward (i.e., if the front leg 30 and the rear leg 40 are swung forward) from a state shown in FIG. 13, a corner part 27 comes closer to the stopper member 31 and then passes nearby the stopper member 31, so as to be moved relatively rearward of the stopper member 31 (see FIG. 14). The corner part 27 is opposite of a corner part at which the fourth shaft 22 is provided at the other end of the rear leg 40. Eventually, an end face 46 which is facing forward in the rear leg 40 is brought into contact with the stopper member 31, thereby inhibiting the rear leg 40 from further being swung.

The above chair 1 is provided with a not-shown biasing device that is biasing at least one of the front leg 30 and the rear leg 40 in a forward direction. When no outer force is applied (when a user is not seated), the seat body 10 is in a state in which the seat body 10 is moved to the front end position.

At the front end position when the seat body 10 is moved most forward, the backrest 12 is substantially vertical and the seating face 11 is in a substantially horizontal state.

(2) Movement of the chair 1

(2-1) Movement of the seat body 10 in an up-and-down direction

Figure 4A:
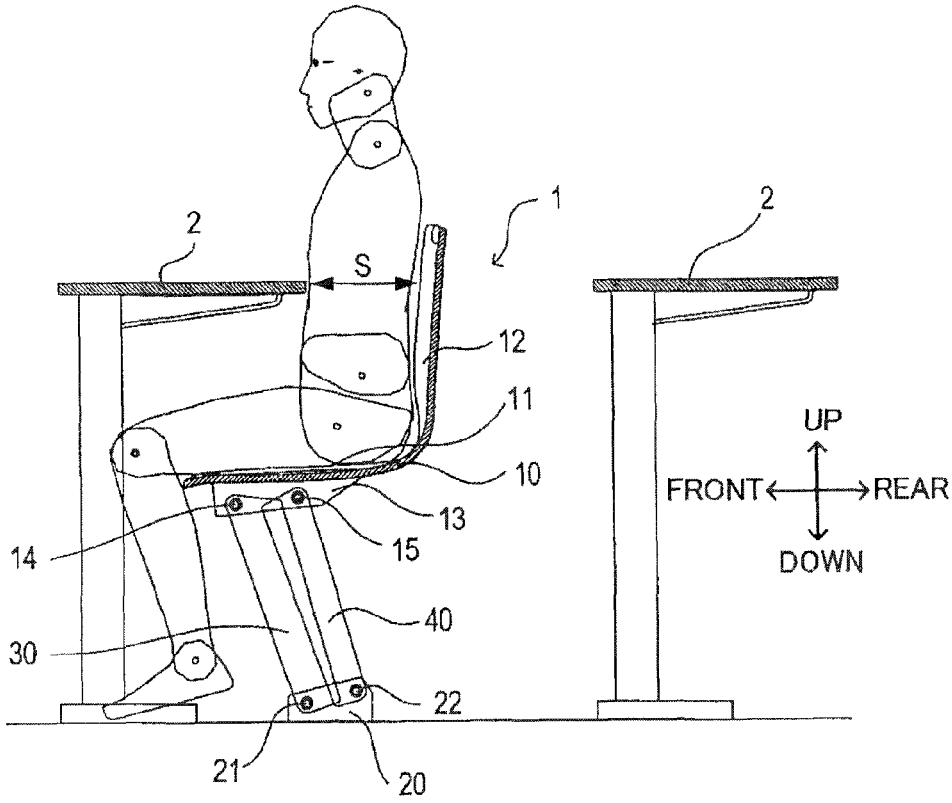
FIG. 4A is a view showing a state in which a user is seated on the chair.

A movement of the chair when a user is seated thereon will be explained. As shown in FIG. 4A, in a state in which the user is seated on the seating face 11, a range within which the seat body 10 can be swung forward is restricted by a width of the user in the front-and-rear direction. Specifically, the seat body 10 cannot be moved to a position at which a distance S between a rear end of a top panel of the desk 2 (an end portion in a direction of REAR in FIG. 4) and the backrest 12 is smaller than the width of the user in the front-and-rear direction. In this case, a boundary position at which the seat body 10 can be swung forward most is defined as a middle position.

Figure 4B:
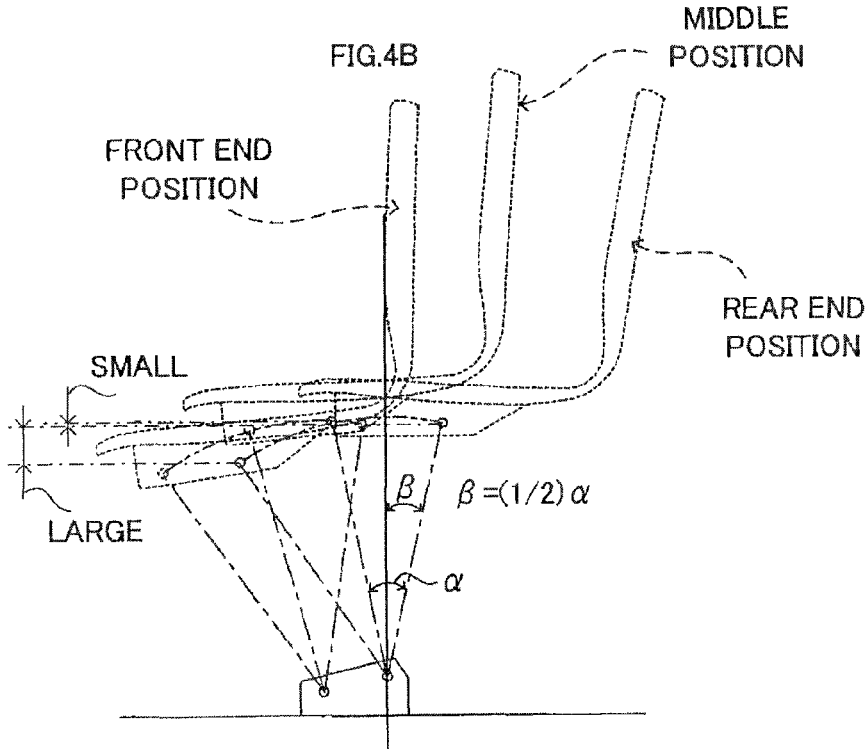
FIG. 4B is a view showing changes in an angle of the rear leg.

FIG. 4B shows an angle range of a swing movement of the rear leg 40 in accordance with a swing movement of the seat body 10. If a rotation angle, through which the rear leg 40 of the seat body 10 is rotated from the rear end position to the middle position, is defined as $\alpha$, an angle $\beta$ between the rear leg 40 at the rear end position and a vertical line is preferably defined as $\beta=(1/2)\alpha$. The reason for this will be explained with reference to FIG. 5.

Figure 5A:
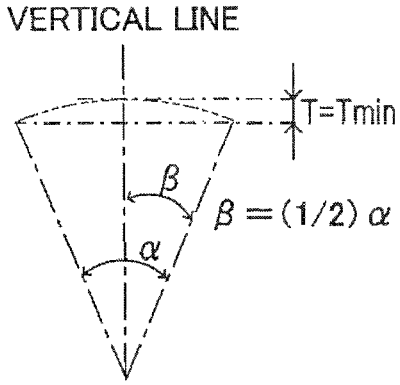
FIG. 5A is a view showing a moving amount of the seat body in an up-and-down direction.

The above rotation angle $\alpha$ is an angle range within which the user can swing the seat body 10 when seating. As shown in FIG. 5A, if a center line of the angle range matches the vertical line, a range T, within which the one end of the rear leg 40 is moved in the up-and-down direction, has the smallest value (Tmin). Accordingly, if $\beta=(1/2)\alpha$, a displacement of the seat body 10 in the up-and-down direction is the smallest when the seat body 10 is swung. Thus, it is not necessary to greatly raise the seat body 10 when the seat body is swung.

Figure 5B:
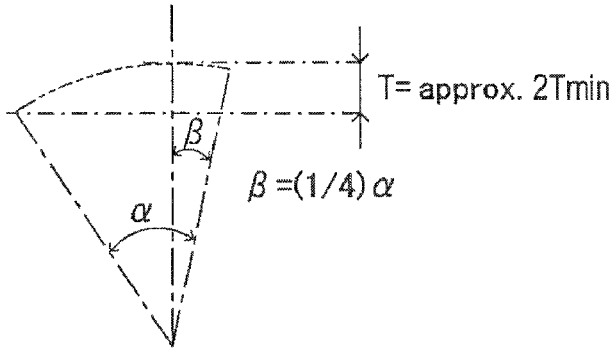
FIG. 5B is a view showing a moving amount of the seat body in the up-and-down direction.
Figure 5C:
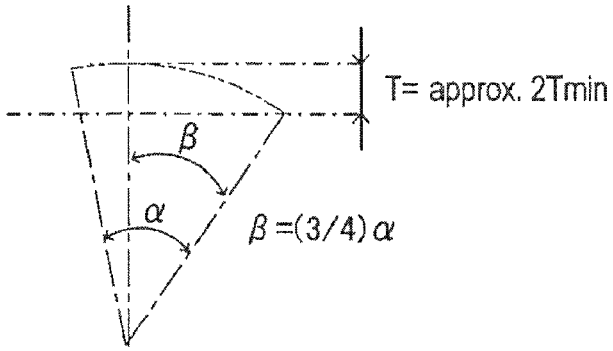
FIG. 5C is a view showing a moving amount of the seat body in the up-and-down direction.

If the displacement range T in the up-and-down direction satisfies $2\,T_{min} \geqq T$, it can be achieved that the seat body 10 is swung comfortably without greatly raising the seat body 10. If the range of the angle $\beta$ in this case, as shown in FIGS. 5B and 5C, falls within a range of $(3/4)\alpha \geqq \beta \geqq (1/4)\alpha$, the above described range T can be satisfied.

On the other hand, as shown in FIG. 4B, if the seat body 10 is swung from the middle position to the front end position, the seat body 10 is greatly moved downward.

As shown in FIG. 4B, in the chair 1 constituted as above, when the seat body 10 is at the rear end position, the rear leg 40 is tilted rearward by the angle $\beta$ from the vertical line. Therefore, when the user is seated, the seat body 10 is biased toward the rear end position by weight of the user, thereby making the seat body 10 stable at the rear end position when the user is seated.

Here, the above mentioned tilt angle of the rear leg 40 indicates an angle of a line segment, which connects the rotation axis of the second shaft 15 with the rotation axis of the fourth shaft 22, in relation to the vertical line.

(2-2) Tilting Movement of the Seat Body 10

Figure 6:
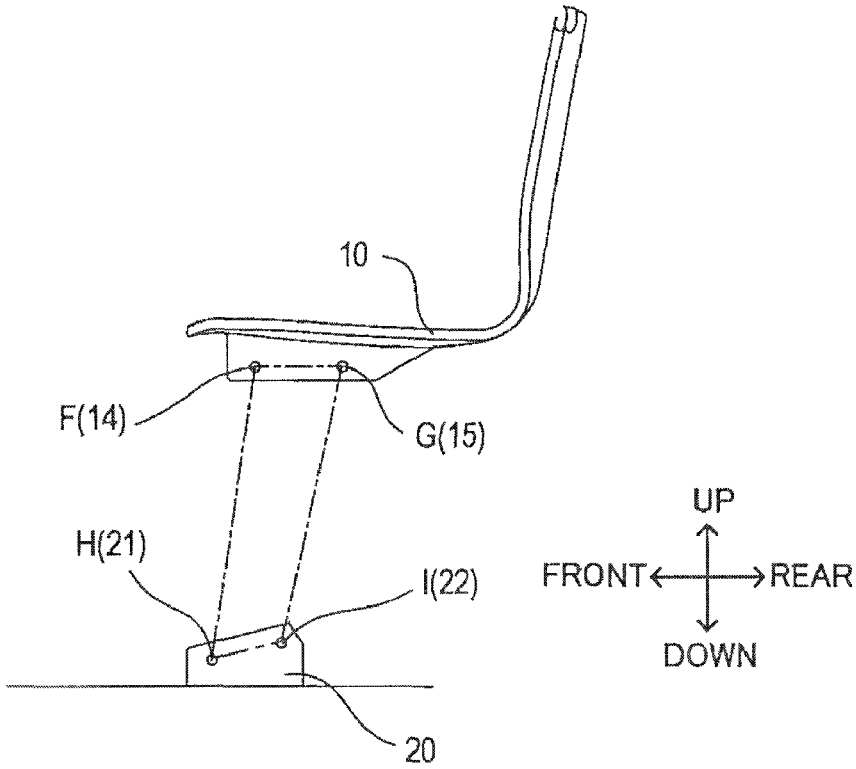
FIG. 6 is a schematic view of a four-link joint.

In the chair 1, a four-link joint is formed by each shaft described above which serves as a rotation axis of the four-link joint. The four-link joint is schematically shown in FIG. 6. The rotation axes which correspond to the first to the fourth shaft 22 are respectively designated as F to I.

Since each shaft is arranged as described above, the four-link joint has following features:

(i) a distance between F and G is longer than a distance between H and I;

(ii) a distance between F and H is longer than a distance between G and I; and (iii) H is located at a position lower than I.

Figure 7:
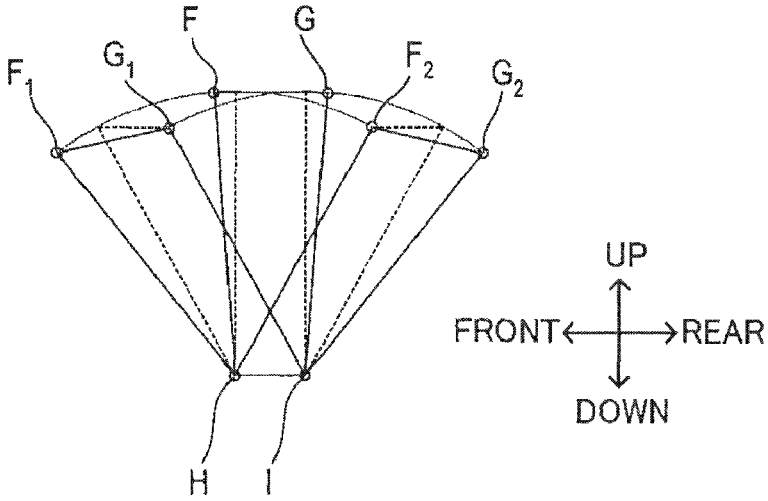
FIG. 7 is a schematic view illustrating an action of the chair.

An operation of the above (i) will be explained with reference to FIG. 7. A broken line shows a diagram when the distance between F and G and the distance between H and I are equal. In this case, if the swing movement is performed in the front-and-rear direction, a tilt angle of the line segment FG does not change. A solid line shows a diagram when the distance between F and G is longer than the distance between H and I. In this case, when the line segment FG is swung forward, compared to the line segment FG before the swing movement (the line segment FG), the line segment FG after the swing movement (the line segment $F_1G_1$) is tilted such that a side of the rotation axis F of the line segment FG is lowered. Similarly, when the line segment FG is swung rearward, compared to the line segment FG before the swing movement (the line segment FG), the line segment FG after the swing movement (the line segment $F_2G_2$) is tilted such that a side of the rotation axis G of the line segment FG is lowered.

The line segment FG is a line segment which connects the rotation axes of the first shaft 14 and the second shaft 15, both of which support the seat body 10. Thus, tilt angles of the seating face 11 and the backrest 12 of the seat body 10 can be changed depending on a swing position, since the above feature (i) is included.

Figure 8A:
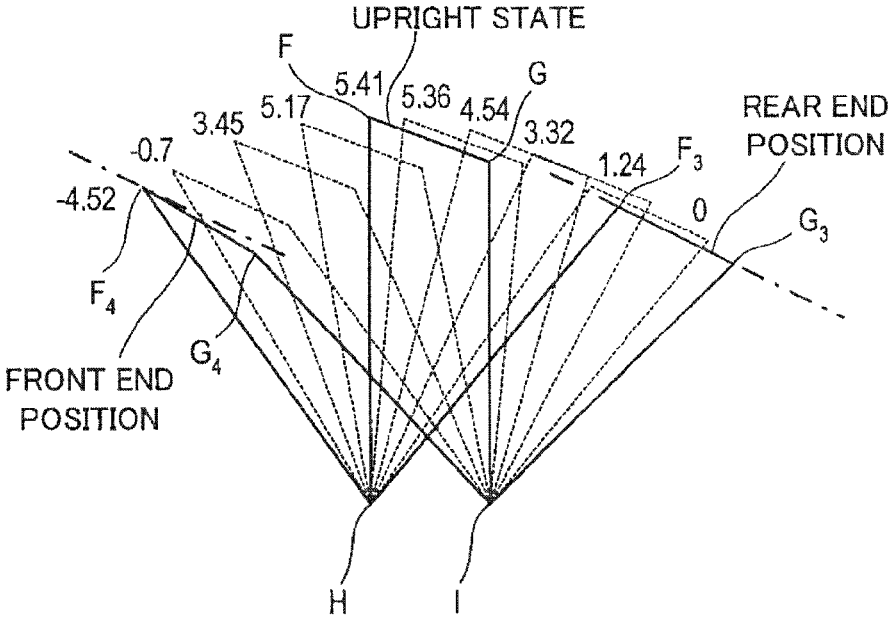
FIG. 8A is a schematic view illustrating the action of the chair.

Next, an effect of the above feature (ii) will be explained with reference to FIG. 8A. FIG. 8A is a diagram showing an angle change of the line segment FG when the four-link joint, in which the distance between F and H is longer than the distance between G and I, is swung. In FIG. 8A, in an upright state, the four-link joint having the line segment FH parallel to the line segment GI is illustrated. Also, in FIG. 8A, since the line segment FG is longer than the line segment HI, it is noted that the above feature (i) is included in FIG. 8A.

In a case that an angle of the line segment FG ($F_3G_3$) at the rear end position is defined as a reference (0°), if the swing movement is performed toward the upright state, the tilting is performed such that a rear side (a G side) is raised. Numeral values in the figure indicate angle changes in accordance with the swing movement. Positive numeral values indicate that the rear side (the G side) is raised, while negative numeral values indicate that the rear side is lowered. On the other hand, if the swinging movement is performed further toward the front end position ($F_4G_4$) from the upright state, the tilting is performed such that the rear side is gradually lowered.

As above, since the distance between F and H is longer than the distance between G and I, in the case of the chair 1 of the present example, the seat body 10 is tilted rearward in a vicinity of the front end position, compared to the chair configured such that the distance between F and H is equal to the distance between G and I. Thus, by combining the features (i) and (ii), when the seat body 10 is swung from the rear end position toward the front end position, it may be possible to adjust the seat body 10 so that the seat body 10 does not become too tilted forward in the vicinity of the front end position. Accordingly, at the front end position, the backrest 12 of the seat body 10 can be substantially vertical and the seating face 11 can be maintained substantially horizontal.

A degree of tilting at the G side by the swing movement described above can be adjusted by changing a proportion of the distance between F and H to the distance between G and I, or a proportion of the distance between F and G to the distance between H and I, and the like.

Figure 8B:
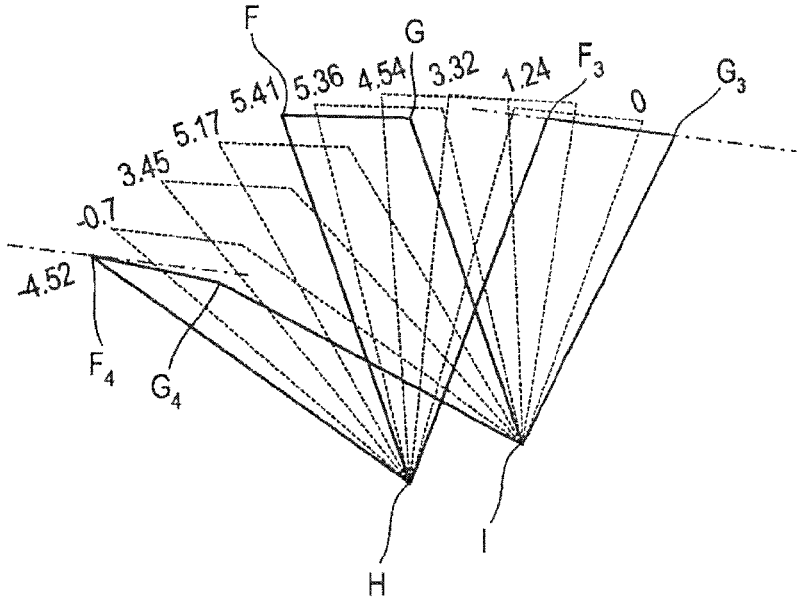
FIG. 8B is a schematic view illustrating the action of the chair.

When the above feature (ii) is combined, as shown in FIG. 8A, the line segment FG is tilted rearward in relation to the line segment HI. In this case, if the above feature (iii) is combined, as shown in FIG. 8B, the FG can be maintained substantially horizontal.

(3) Effect

The chair 1 as constituted above makes it easier for a person to pass behind the chair 1. The reason therefore is that, when the seat body 10 is at the front end position, the backrest 12 is substantially vertical thereby providing a large space behind the chair 1. Also, when the seat body 10 is at the rear end position, the backrest is tilted rearward. Thus, a user's comfort during seating will not be compromised.

Also, the first shaft 14 and the second shaft 15 are arranged in the front part of the seat body 10. Accordingly, the leg receiver 20 is located in the vicinity of the front region. Therefore, when the seat body 10 is at the front end position, the leg receiver 20 is inhibited from being positioned greatly rearward of the seat body 10. As a result, the leg receiver 20 can be inhibited from being an obstruction in a person's passage.

In addition, in the chair 1 as constituted above, when the seat body 10 is moved to the front end position, the seating face 11 will not be greatly tilted forward or rearward. If baggage is placed on the seating face 11, the baggage is not likely to be slid off from the seating face 11. Therefore, the baggage can be placed on the seating face 11. Accordingly, it is not necessary to place the baggage on the top panel of the desk 2 or to push the baggage into a small shelf under the top panel.

Moreover, in the chair 1 as constituted above, as explained above, when the seat body 10 is at the rear end position, the front leg 30 and the rear leg 40 are slightly tilted rearward from the vertical line. Thus, in a case of providing a passage behind the chair while a user is seated, such as, when a person passes behind the chair while a user is seated, it is not necessary to greatly raise the seat body 10 when the seat body 10 is swung forward from the rear end position while the user is seated, thereby allowing the seat body 10 to be easily swung forward.

Furthermore, when the seat body 10 is swung to the front end position, the seat body 10 is greatly moved downward. As a result, a space between the seat body 10 and the top panel of the desk 2 becomes larger, thereby providing a large space in which baggage and the like can be placed.

(4) Modifications

While the embodiment of the present invention has been described as above, it is obvious that the present invention is not limited to the above embodiment and various modifications can be made as long as they are within the technical scope of the present invention.

For example, the above embodiment illustrates the front leg 30 and the rear leg 40 as each having a U-shaped transverse cross section. However, the front leg 30 and the rear leg 40 may be formed in a column shape, such as a cylindrical column shape and a polygonal column shape, or the like.

The leg receiver 20 may be formed integrally with the desk 2.

While the above embodiment illustrates the four-link joint which includes all of the above described features (i) to (iii), the four-link joint is not limited to the configuration having all of the features, but may be configured to include one or two of the above features.

Figure 15:
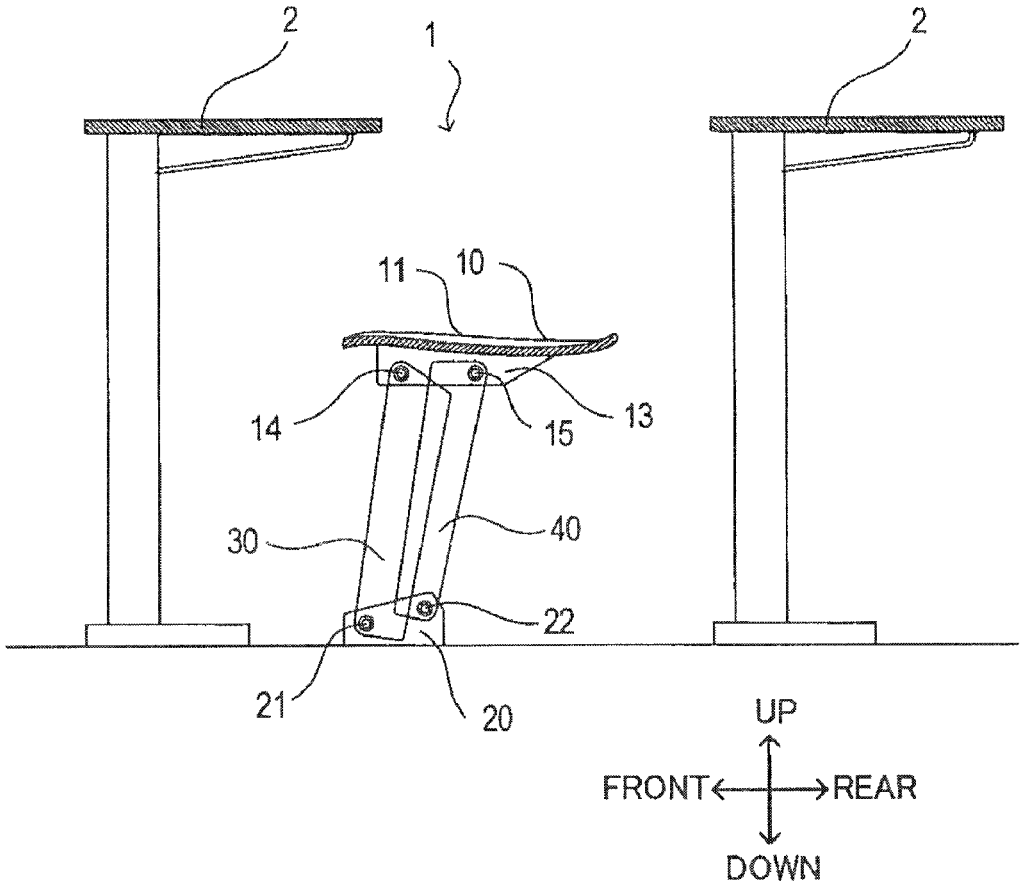
FIG. 15 is a side elevational view showing a chair according to a modification.

A configuration without the backrest 12 may also be possible as shown in FIG. 15, for example.

In the above embodiment, it may be configured that a rotation range of the seat body 10 is restricted as a range in which the seating face 11 is maintained substantially horizontal regardless of the rotating position of the seat body 10.

What is claimed is:

1. A chair, comprising:

a seat body that includes a seat part having a seating face for a person to sit on and a backrest for a person to lean against;

a front leg, a first end of which is attached to an underside region of the seat part in such a manner that the first end of the front leg is capable of being rotated in relation to the seat body, the underside region being an opposite side of the seating face;

a rear leg, a first end of which is attached to the underside region at a position closer to a backrest side than a position at which the first end of the front leg is attached in such a manner that the first end of the rear leg is capable of being rotated in relation to the seat body; and a leg receiver configured to be arranged on a floor surface, wherein a second end of the front leg is rotatably attached to the leg receiver, and a second end of the rear leg is rotatably attached to the leg receiver at a position closer to the backrest side than a position at which the second end of the front leg is attached;

wherein the seat body is capable of being swung between a front end position and a rear end position, the front end position is a position in which each of the front leg and the rear leg are swung to a predetermined end position in a forward direction which goes from the rear leg toward the front leg, the rear end position is a position in which each of the front leg and the rear leg are swung to a predetermined end position in a rearward direction which is opposite to the forward direction, and the backrest is upright in a substantially vertical direction at the front end position; and wherein a distance between a rotation axis at the first end of the front leg and a rotation axis at the second end of the front leg is longer than a distance between a rotation axis at the first end of the rear leg and a rotation axis at the second end of the rear leg.

2. The chair according to claim 1, wherein the seating face is a substantially flat surface and substantially horizontal at the front end position.

3. The chair according to claim 1, wherein a distance between the rotation axis at the first end of the front leg and the rotation axis at the first end of the rear leg is longer than a distance between the rotation axis at the second end of the front leg and the rotation axis at the second end of the rear leg.

4. The chair according to claim 3, wherein a distance between the rotation axis at the second end of the front leg is, in comparison with the rotation axis at the second end of the rear leg, arranged at a position closer to the floor surface at the leg receiver.

5. The chair according to claim 1, wherein the first end of the front leg and the first end of the rear leg are attached to a front half region of the underside region of the seat body.

6. The chair according to claim 1, wherein the chair includes a stopper that defines a range within which the front leg and the rear leg are capable of being swung.

7. A chair, comprising:

a seat body that includes a seat part having a seating face which is a substantially flat surface to be used for a person to sit on; and a leg, a first end of the leg configured to be connected at a floor surface side and a second end of the leg being connected to the seat body;

wherein the leg is capable of being swung around a connecting point of the leg with the floor surface side, and the leg is capable of being swung within a pre-determined range in a predetermined direction between a front end position and a rear end position;

wherein the seat body is capable of being swung within the pre-determined range between the front end position and the rear end position; and wherein the seating face is maintained substantially parallel in relation to a horizontal plane at at least one of the front and rear positions of the range within which the leg is capable of being swung.

8. The chair according to claim 7, wherein in the range within which the leg is capable of being swung, the seating face is maintained substantially parallel in relation to the horizontal plane, regardless of a swinging position of the leg.

* * * * *